US007690776B2

(12) United States Patent
DeVore et al.

(10) Patent No.: US 7,690,776 B2
(45) Date of Patent: Apr. 6, 2010

(54) GASEOUS DETECTION FOR AN INKJET SYSTEM

(75) Inventors: David Wayne DeVore, Richmond, KY (US); Gina Marie Johns, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 116 days.

(21) Appl. No.: 11/965,818

(22) Filed: Dec. 28, 2007

(65) Prior Publication Data

US 2008/0100647 A1 May 1, 2008

Related U.S. Application Data

(62) Division of application No. 11/007,561, filed on Dec. 7, 2004, now Pat. No. 7,354,142.

(51) Int. Cl.
*B41J 2/19* (2006.01)

(52) U.S. Cl. ..... 347/92

(58) Field of Classification Search ..... 347/92, 347/93–94, 86, 84
See application file for complete search history.

(56) References Cited

U.S. PATENT DOCUMENTS 4,153,902 A 5/1979 Kanayama
4,301,459 A 11/1981 Isayama et al.
4,399,446 A 8/1983 McCann et al.
4,771,295 A 9/1988 Baker et al.
5,475,403 A 12/1995 Havlovick et al.
5,546,109 A 8/1996 Nakano
5,621,445 A 4/1997 Fong et al.
5,808,643 A 9/1998 Tracy et al.
5,828,395 A 10/1998 Takata
6,270,211 B1 8/2001 Long et al.
6,290,343 B1 9/2001 Lewis et al.
6,302,503 B1 10/2001 Seu
6,318,851 B1 11/2001 Hoen et al.
6,398,354 B1 6/2002 Lattuca et al.
6,478,417 B2 11/2002 Hoen et al.
6,485,137 B2 11/2002 Karlinski et al.
6,517,189 B2 2/2003 Ogawa et al.
6,609,792 B2 8/2003 Kaga et al.
6,761,445 B2 7/2004 Hoen et al.
6,966,642 B2 11/2005 Hanaoka et al.
2002/0024573 A1 2/2002 Hoen et al.
2002/0057320 A1 5/2002 Kaga et al.
2003/0206221 A1 11/2003 Hoen et al.
2004/0218026 A1 11/2004 Matsushita et al.

*Primary Examiner*—K. Feggins

(57) ABSTRACT

A method of monitoring gaseous accumulation within an ink flow path in fluid communication with a printhead comprising: (a) supplying a first printhead with ink using a first ink flow path; (b) mounting a first ink filter in fluid communication with the first printhead; and (c) sensing downstream from the first ink filter for gaseous components within the first ink flow path. In addition, the invention provides a printing device comprising: (a) a first printhead that includes a first set of nozzles, a first ink filter, and a first conduit between the first ink filter and the first set of nozzles for delivering filtered ink to the first set of nozzles; and (b) a sensor operative to detect at least one of bubble formation and bubble growth within the first conduit.

12 Claims, 8 Drawing Sheets

GASEOUS DETECTION FOR AN INKJET SYSTEM

CROSS REFERENCE TO RELATED APPLICATIONS

The present application claims priority under 35 U.S.C. §§120, 121 to, and is a divisional of, U.S. patent application Ser. No. 11/007,561 filed on Dec. 7, 2004, now U.S. Pat. No. 7,354,142.

RELATED ART

1. Field of the Invention

The present invention is directed to inkjet printers, and more specifically to devices and methods for detecting the presence of gaseous impediments within ink conduits that might impair the flow of ink between an ink source and nozzles of a printhead.

2. Brief Discussion of Related Art

Inkjet printers include at least one printhead having numerous nozzles through which ink is ejected in the form of droplets that are preferably deposited onto a printable medium. The precise and accurate deposition of droplets form image-based, dielectric, and/or conductive representations. In order to deposit ink onto the printable medium, the printhead includes numerous electric resistors that are selectively "fired". A resistor is "fired" by directing electric current therethrough to generate thermal energy sufficient to vaporize a fraction of liquid ink in thermal communication with the resistor, thereby generating a vapor bubble that forces a droplet of liquid ink from the nozzle. The resistor firing sequence occurs numerous times a second and is coordinated with the movement of the nozzles across the printable medium by associated controls of the printer.

An electronic version of the representation to be printed is commonly referred to as a bit map. A bit map includes instructions regarding the position of the nozzles in order to deposit ink in predetermined locations on the print medium. This means that at least one of the nozzles and the print medium must be repositionable. An exemplary manner of repositioning the print medium with respect to the nozzles may include moving the print medium vertically and moving the nozzles horizontally along a reel to cover the relevant areas of an imaginary X-Y plane. The operation of a reel and movement of the printhead in accordance with the instructions of the bit map are well known by those of ordinary skill.

SUMMARY OF THE INVENTION

The present invention includes devices and methods for detecting the presence of gaseous deposits within conduits located between an ink source and nozzles of a printhead. As will be discussed in more detail below, the present invention may utilize an optical sensor for detecting the presence of gaseous impediments, which may include ink vapor bubbles, downstream from an ink filter. The sensor may be operative to generate and send signals indicative of ink flow impairment to the printer controller, and the printer controller, upon receipt of these signals, may discontinue printing if the impairment of ink flow is significant and/or would lead to printhead damage if printing was continued without correcting the impairment. Exemplary embodiments include mounting the sensor to a printhead, where the printhead includes a translucent lens operative to allow optical communication between a downstream portion of the ink conduit and the sensor. In a detailed exemplary embodiment, the invention may include the sensor interfacing with electronic controls of the printer to alert a user that the flow of ink to the printhead is blocked or impaired and notify the user that further printing operations may cause damage the printhead. In a further detailed exemplary embodiment, the alert may include instructions to the user for manually purging the gaseous deposits from the ink conduit. In a yet a further detailed exemplary embodiment, the alert may include the electronic controls activating an automated purging sequence to eliminate the gaseous impediments. It is to be understood that the gaseous impediments may result from consumption of the ink in fluid communication with the printhead, in which case ink replenishment may be required.

In accordance with an embodiment of the present invention, a method is provided for monitoring gaseous accumulation within an ink flow path in fluid communication with a printhead. As described herein, the method can include the steps of (a) supplying a first printhead with ink using a first ink flow path; (b) mounting a first ink filter in fluid communication with the first printhead; and (c) sensing downstream from the first ink filter for gaseous components within the first ink flow path.

In another embodiment, the downstream sensing within the first ink flow path uses an optical sensor. In another more detailed embodiment, the optical sensor is a component of at least one of a removable ink tank and the first printhead. In a further detailed embodiment, the first printhead traverses across a reel of a printer, and the optical sensor is stationary with respect to the first printhead. In still a further detailed embodiment, the first printhead traverses across a reel of a printer, and the optical sensor is stationary with respect to the printer. In a more detailed embodiment, the method also includes generating a signal in response to sensing gaseous components downstream from the first ink filter, and automatically redirecting at least some of the gaseous components in response to the signal generation. In a more detailed embodiment, the method also includes supplying a second printhead with ink using a second ink flow path, mounting a second ink filter in fluid communication with the second printhead, sensing downstream from the second ink filter for gaseous components within the second ink flow path, supplying a third printhead with ink using a third ink flow path, mounting a third ink filter in fluid communication with the third printhead, and sensing downstream from the third ink filter for gaseous components within the third ink flow path.

In still another embodiment, the first printhead, the second printhead, and the third printhead traverses across a reel of a printer, and supplying the first printhead, the second printhead, and the third printhead with ink includes providing at least one removable reservoir in fluid communication therewith. In still another more detailed embodiment, the downstream sensing within the first ink flow path, the second ink flow path, the third ink flow path includes utilizing an optical sensor, and the optical sensor is stationary with respect to the printer. In a further detailed embodiment, the downstream sensing within the first ink flow path, the second ink flow path, and the third ink flow path includes utilizing a plurality of optical sensors, and at least one of the plurality of optical sensors is stationary with respect to the printer. In still a further detailed embodiment, the method also includes generating a signal in response to sensing gaseous components downstream from at least one of the first ink filter, the second ink filter, or the third ink filter, and signaling a user of the printer that gaseous components have been detected downstream from at least one of the first ink filter, the second ink filter, or the third ink filter and providing instructions for redirecting at least some of the gaseous components. In a more detailed embodiment, the method also includes generating a signal in response to sensing gaseous components downstream from at least one of the first ink filter, the second ink filter, or the third ink filter, and automatically redirecting at least some of the gaseous components in response to the signal generation.

In accordance with another embodiment of the present invention, a printing device is described that includes: (a) a first printhead comprising: (i) a first set of nozzles, (ii) a first ink filter, and (iii) a first conduit between the first ink filter and the first set of nozzles for delivering filtered ink to the first set of nozzles; and (b) a sensor operative to detect at least one of bubble formation and bubble growth within the first conduit.

In another embodiment, the first conduit includes a first bubble accumulation area, and the sensor is in sensing communication with the first bubble accumulation area. In still another more detailed embodiment, the ink filter is mounted to the conduit at an angle to direct bubbles within the filtered ink to the bubble accumulation area. In a further detailed embodiment, the sensor includes an optical sensor. In still a further detailed embodiment, the printhead is disposable, and the sensor is integrated into the printhead. In a more detailed embodiment, the printhead is disposable, and the sensor is a standalone item.

In accordance with another embodiment of the present invention, an inkjet printer is provided that includes: (a) a first printhead comprising: (i) a first set of nozzles, (ii) a first ink filter, (iii) a first ink reservoir in fluid communication with the first ink filter, and (iv) a first conduit between the first ink filter and the first set of nozzles for delivering filtered ink to the first set of nozzles; (b) a reel adapted to traverse the first printhead across a width of a print medium; (c) a sensor operative to detect at least one of bubble formation and bubble growth within the first conduit; and (d) electronic controls for automatically directing the first printhead into position and controlling firing of the first set of nozzles.

DETAILED DESCRIPTION

The exemplary embodiments of the present invention are described and illustrated below to encompass devices and methods for detecting the presence of gaseous impediments within conduits located between an ink source and nozzles of a printhead. Of course, it will be apparent to those of ordinary skill in the art that the preferred embodiments discussed below are exemplary in nature and may be reconfigured without departing from the scope and spirit of the present invention. However, for clarity and precision, the exemplary embodiments discussed below may include optional features that one of ordinary skill will recognize as not being a requisite to fall within the scope of the present invention.

Figure 1:
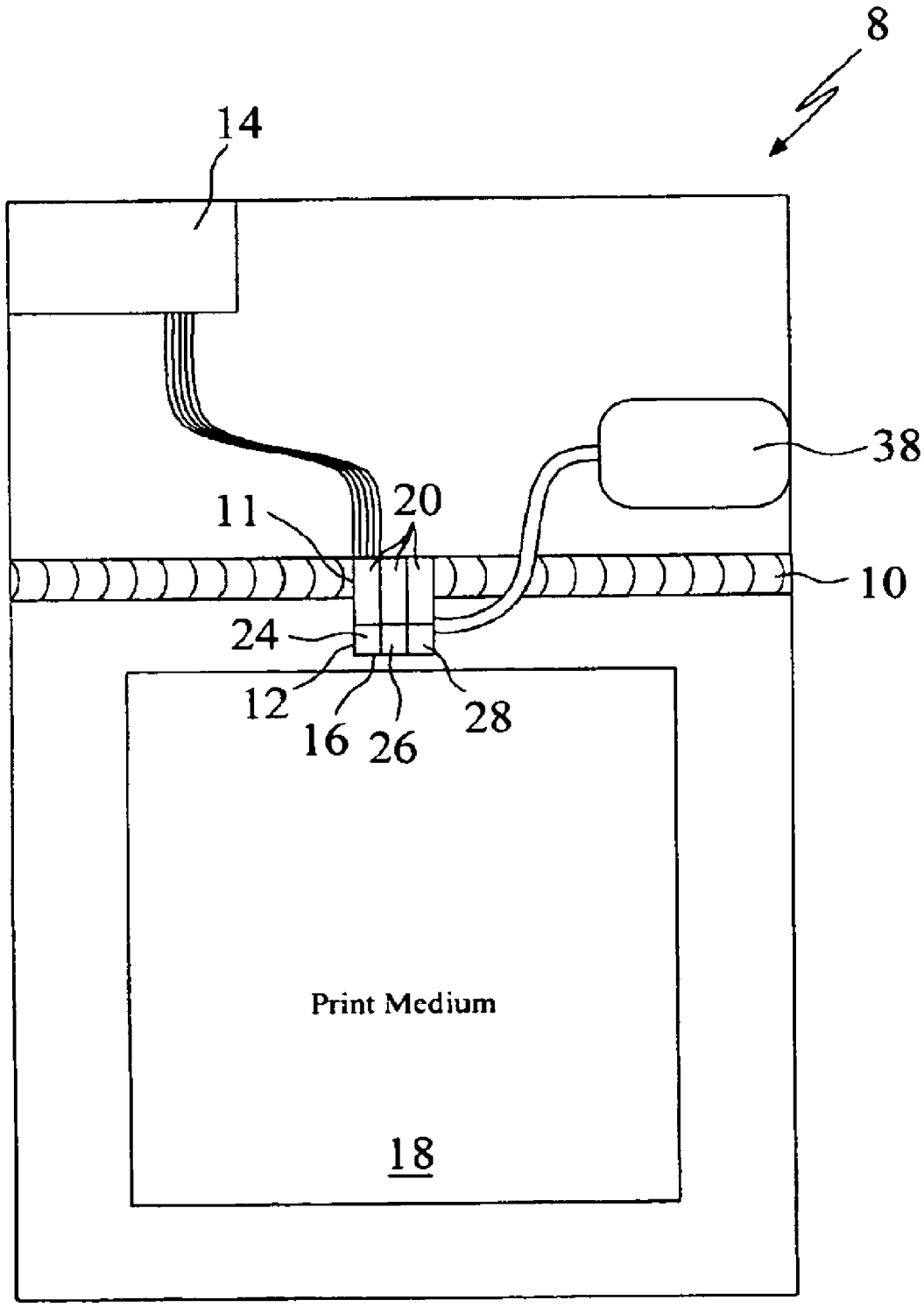
FIG. 1 is an overhead view of a first exemplary printer incorporating sensors with an on-carrier printhead, where the sensors are operative to detect vapor accumulation below an ink filter in fluid communication with nozzles of a printhead.

Referencing FIG. 1, a first exemplary embodiment of the present invention includes a printer 8 having a reel 10 along which a carriage 11, having a printhead 12 mounted thereto, traverses. A drive mechanism (not shown), controlled by a printer controller 14, is operative to reposition the carriage 11 and printhead 12 along the reel 10. The printhead 12 may include one or more banks of nozzles 16 providing orifices through which ink in fluid communication therewith is selectively deposited onto a print medium 18 per the instructions received from the printer controller 14. Several options are available to provide on-demand ink in fluid communication with the nozzles 16. Among these options include providing one or more ink cartridges (on-carrier chiclets) 20 mounted to the printhead 12, as well as providing one or more ink reservoirs (not shown) in an off-carrier arrangement that are in fluid communication with the printhead 12. For purposes of illustration, the printhead 12 is presumed to be fluidly coupled to one or more on-carrier ink cartridges 20, however, those of ordinary skill will understand that the distinction between on-carrier and off-carrier ink supplies in no way limits the applicability of the present invention only to on-carrier ink supplies.

Figure 2:
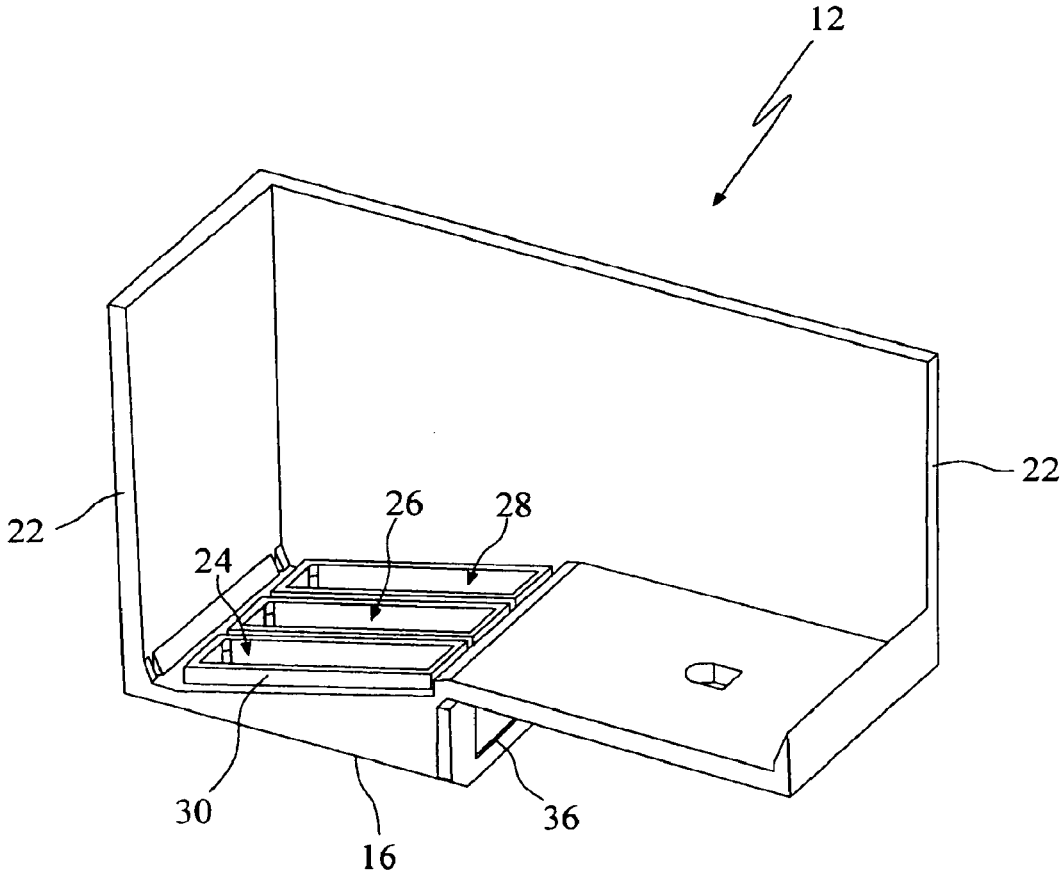
FIG. 2 is an elevated perspective view of an exemplary on-carrier printhead in accordance with the present invention.
Figure 3:
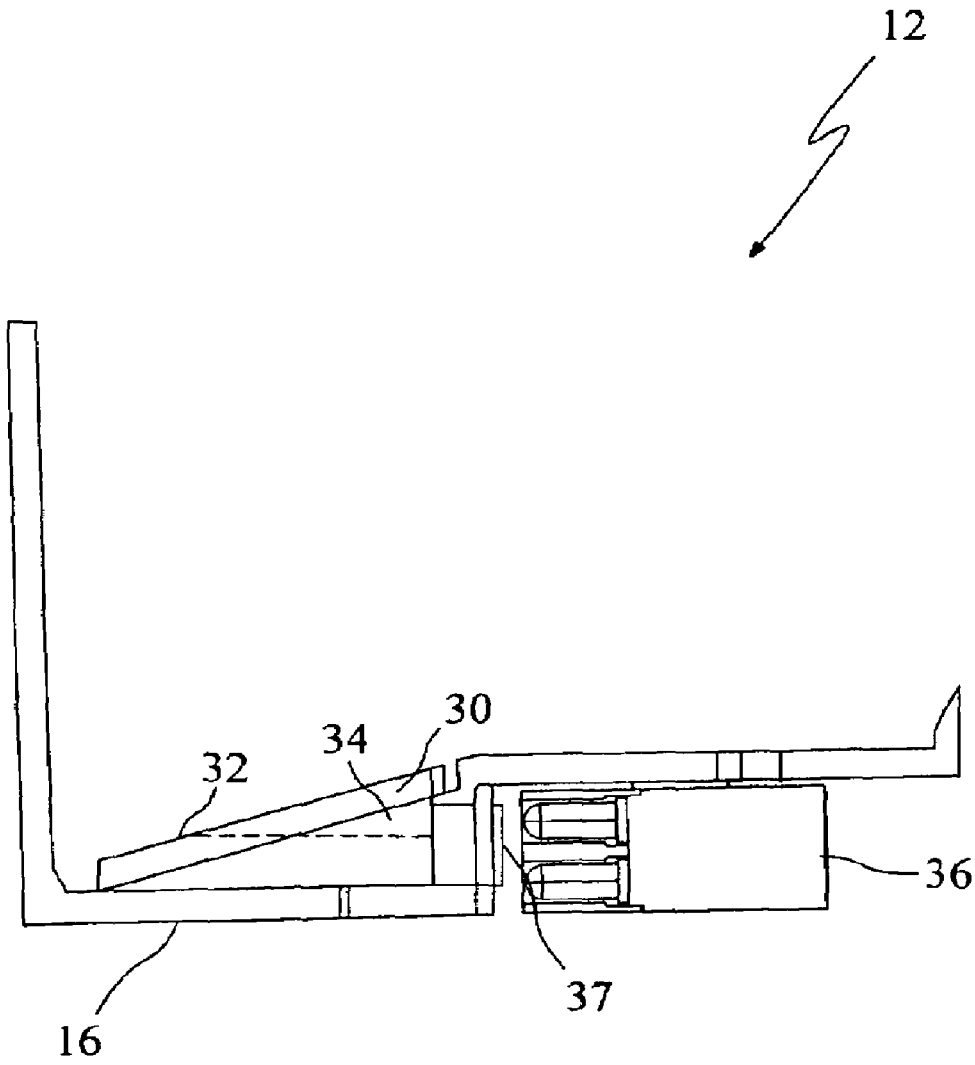
FIG. 3 is a cross-sectional view of the exemplary on-carrier printhead of FIG. 2.

Referencing FIGS. 2 and 3, the exemplary printhead 12 includes an outer housing 22 surrounding three trapezoidally raised bays 24, 26, 28 that are each adapted to fluidly interface with an ink cartridge 20 (See FIG. 1). Each bay 24, 26, 28 includes a raised wall 30 having an ink filter 32 (not shown in FIG. 2) mounted thereto. It is to be understood that the ink filter 32 may comprise a single piece of filter material or may comprise multiple pieces of filter material mounted to each bay 24, 26, 28. In either instance, the orientation of the filter 32 is angled as a result of the angled nature of the bays 24, 26, 28. During normal operation of the printhead 12, the filter 32 is adapted to be in concurrent fluid communication with ink being directed to the printhead 12 and ink traveling from an interior of the ink cartridge 20.

Each trapezoidally raised bay 24, 26, 28 defines a fluidly separate fluid flow path that is adapted to receive a different ink such as, without limitation, cyan colored ink, magenta colored ink, and yellow colored ink. It is to be understood that this exemplary embodiment may be easily reconfigured to accommodate more or less than three colored inks. Still further, it is to be understood that the three separate bays 24, 26, 28 may receive the same colored ink. Even further, it is to be understood that each bay 24, 26, 28 may receive conductive or dielectric based inks for printing microcircuits.

After the ink travels through the respective filter 32 of each bay 24, 26, 28, the ink is directed to one or more nozzles 16 on the underside of the printhead 12. In this exemplary embodiment, the printhead 12 includes three sets of nozzles 16, with each set of nozzles being in fluid communication with one of the bays 24, 26, 28. However, it is to be understood that the bays 24, 26, 28 may all be in fluid communication with the same set of nozzles 16 or each bay 24, 26, 28 may be in fluid communication with more than one set of nozzles 16. Those of ordinary skill are familiar with such configurations.

Referring to FIG. 3, each trapeziodally raised bay 24, 26, 28 includes a vapor collection zone 34 partially bounded by the underside of the filter 32. Vapor present below the filter 32 is directed upward to the highest possible point as a result of buoyancy. In instances where a volume of vapor (bubbles) below the ink filter 32 is too large to pass through the filter 32, the vapor accumulates at the vapor collection zone 34 on the underneath side of the filter 32. It is to be understood that the trapped vapor may act to inhibit the flow if liquid ink through the filter 32 as the vapor occupies a portion of the available openings through the filter 32.

Figure 4:
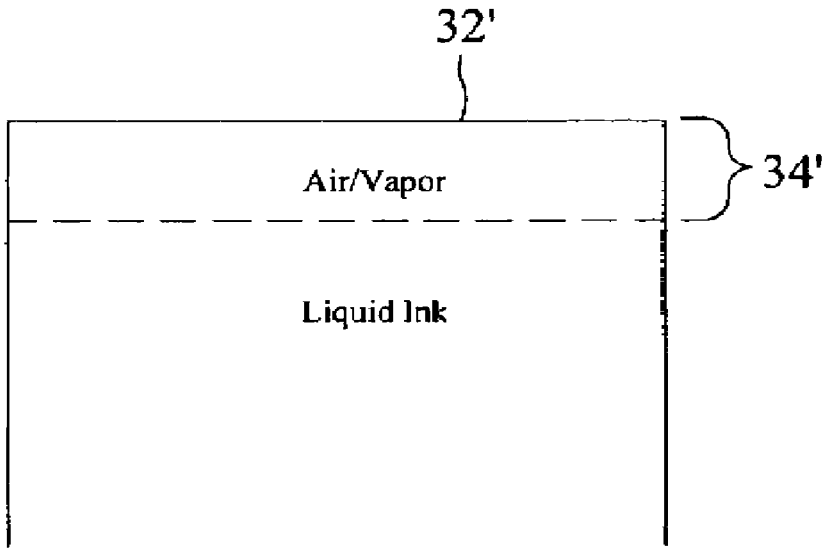
FIG. 4 is a cross-sectional view showing an exemplary instance of vapor accumulation beneath a horizontally positioned ink filter.
Figure 5:
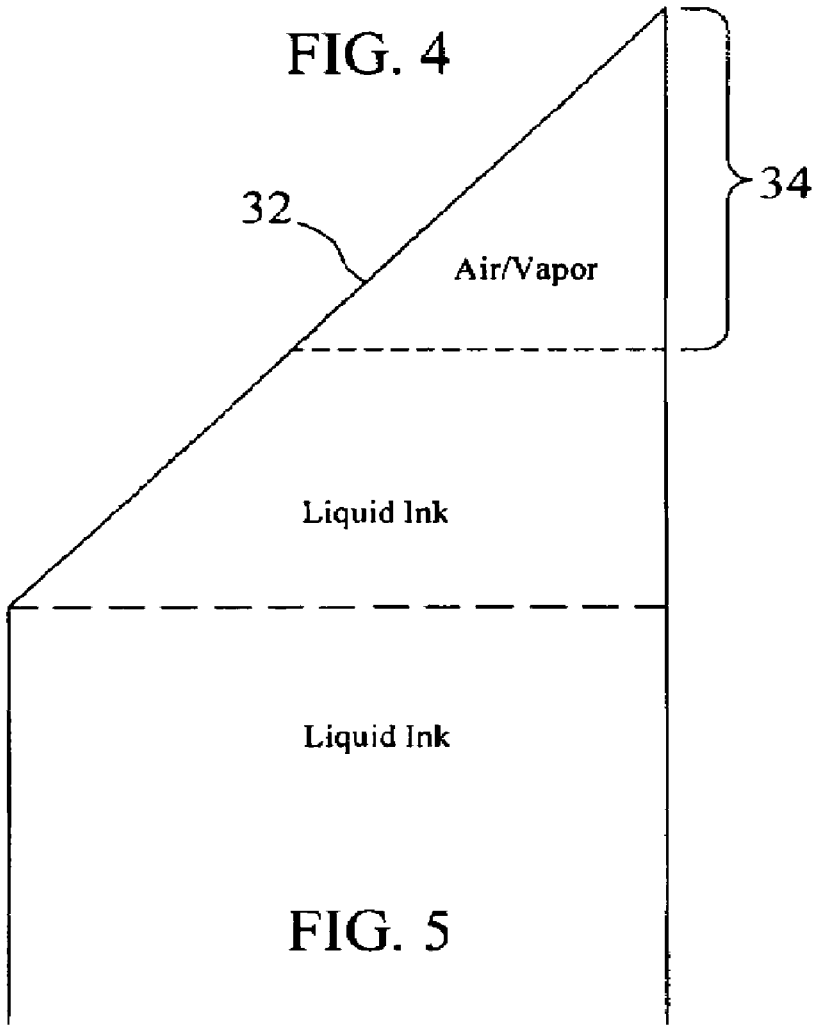
FIG. 5 is a cross-sectional view showing an exemplary instance of vapor accumulation beneath an angled ink filter.
Figure 6:
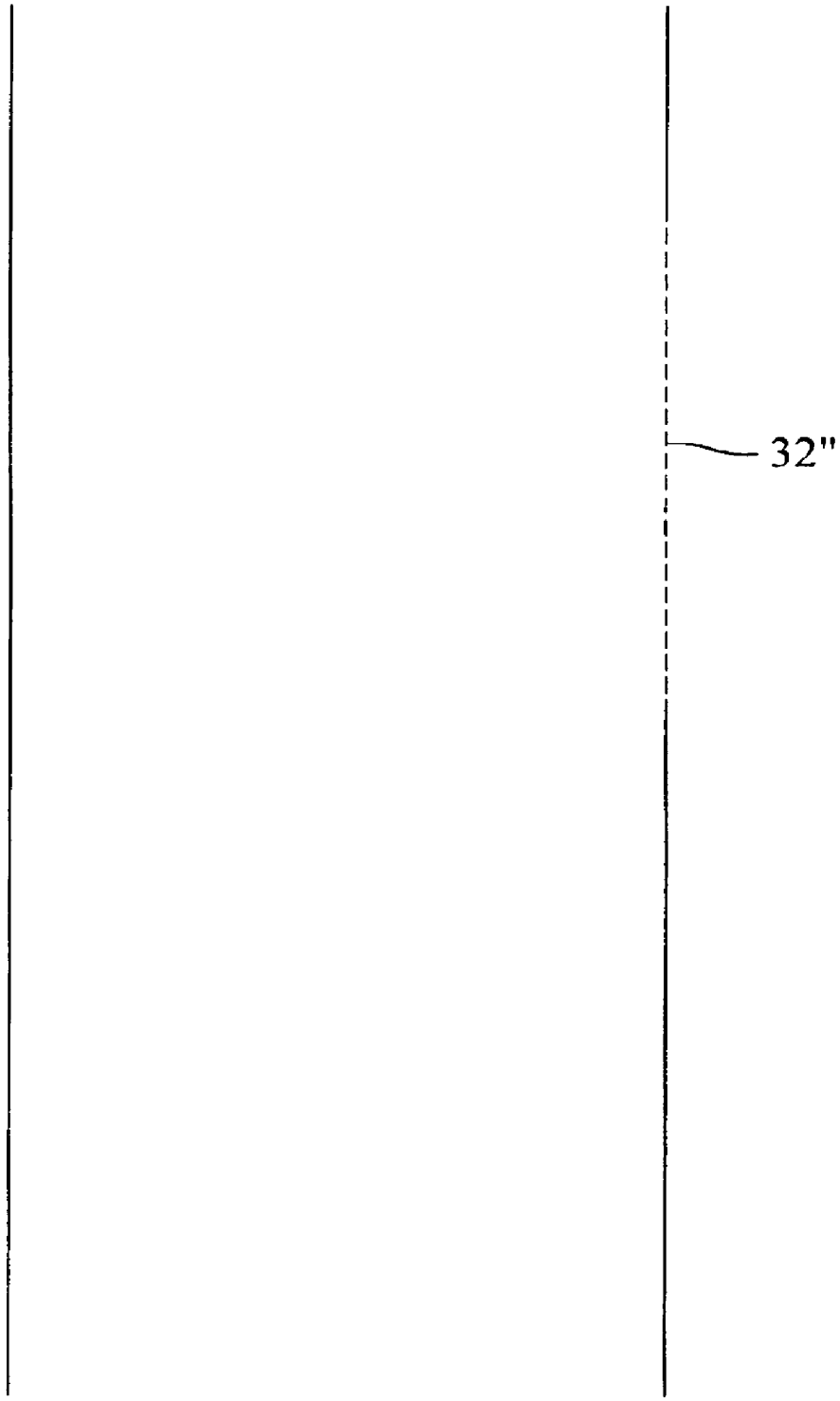
FIG. 6 is a cross-sectional view showing no appreciable vapor accumulation adjacent to a vertically positioned ink filter.

Referencing FIGS. 4-6, it can be seen that an angled filter 32 (FIG. 5) provides more surface area available for ink flow therethrough than a horizontal filter 32' (FIG. 4) for a comparable width and length opening within an ink flow path. As shown in FIG. 4, if the filter 32' is positioned horizontally or has a slight angle, vapor trapped beneath the filter 32' remains in one location and can more easily block the flow of liquid ink through the filter 32'. The angled nature of the filter 32 of FIG. 5 shows that not only does the filter 32 provide more cross sectional area for ink to flow therethrough, but that the angled nature of the filter 32 directs the vapor horizontally as the buoyant nature of the vapor moves it vertically toward the vapor collection zone 34. In this manner, it is easy to see that the angled filter 32 of FIG. 5 may be advantageous over a horizontally positioned filter 32' of FIG. 4. FIG. 6 shows a vertical filter (shown with dashed lines) where the dominant vertical nature of the filter provides little, if any, impediment to upward movement of the vapor, thereby resulting in diminished opportunity for the vapor to block an appreciable area of the filter 32" from ink flow therethrough.

Referring to FIGS. 2 and 3, three sensors 36 (not shown in FIG. 2) are mounted to the printhead 12 to detect vapor within the vapor accumulation zone 34 of each bay 24, 26, 28. A lens 37 mounted adjacent to each bay 24, 26, 28 provides a translucent path between a respective vapor accumulation zone 34 and a respective sensor 36, thereby allowing the sensor 36 to detect the level of vapor accumulation underneath each filter 32 and communicate the degree of vapor detected to the printer controller 14. In this manner, the printer controller 14 is provided with real-time information regarding the degree of vapor accumulated underneath each filter 32. An exemplary material for use as a lens 37 includes polypropylene having the appropriate haze and transmission properties allowing light to pass therethrough.

The printer controller 14 is programmed to determine whether signals received from each sensor 36 are indicative of conditions that might be harmful to the printhead 12, such as, without limitation, nozzle 16 starvation and dry firing. If the controller 14 determines that one or more signals are indicative of an accumulation of vapor surpassing a predetermined threshold, the controller 14 may stop the printing sequence. Other possible exemplary responses of the controller 14 to surpassing the predetermined vapor accumulation threshold may include sending a signal to an automatic purging device 38 associated with the printhead 12, such as, without limitation, a purge pump 38 to create a pressure differential and redirect the vapor from underneath the filter 32. An exemplary purging technique includes providing a sealed perimeter exterior to and around the nozzles 16 to provide a low pressure area (commonly referred to as providing a vacuum) drawing ink from within the printhead to displace the accumulated vapor. An alternate exemplary technique includes providing a port (not shown) in direct communication with the accumulation area 34 and creating a low pressure area drawing the vapor from the accumulation area and through the port, such as by pumping. Still further exemplary responses by the printer controller 14 to significant vapor accumulation include prompting a user of the printer 8 to manually purge the vapor accumulated underneath the filter 32 and/or to replace/refill the ink reservoir 20 in fluid communication with the nozzles 16.

It is also within the scope of the present invention to prime the printhead 12 using positive pressure in response to the controller 14 determining that a signal from one sensor 36 is indicative of a level of vapor surpassing a predetermined vapor accumulation threshold. Those of ordinary skill are familiar with off-carrier ink delivery systems that provide positive pressure ink flow between an off-carrier ink reservoir and an on-carrier printhead using a pump. The positive pressure supplied by the pump is commonly discontinued subsequent to establishing liquid communication between the ink and filter tower. However, the pump may also be utilized to force ink through the tower and displace the vapor accumulated beneath the filter 32.

Figure 7:
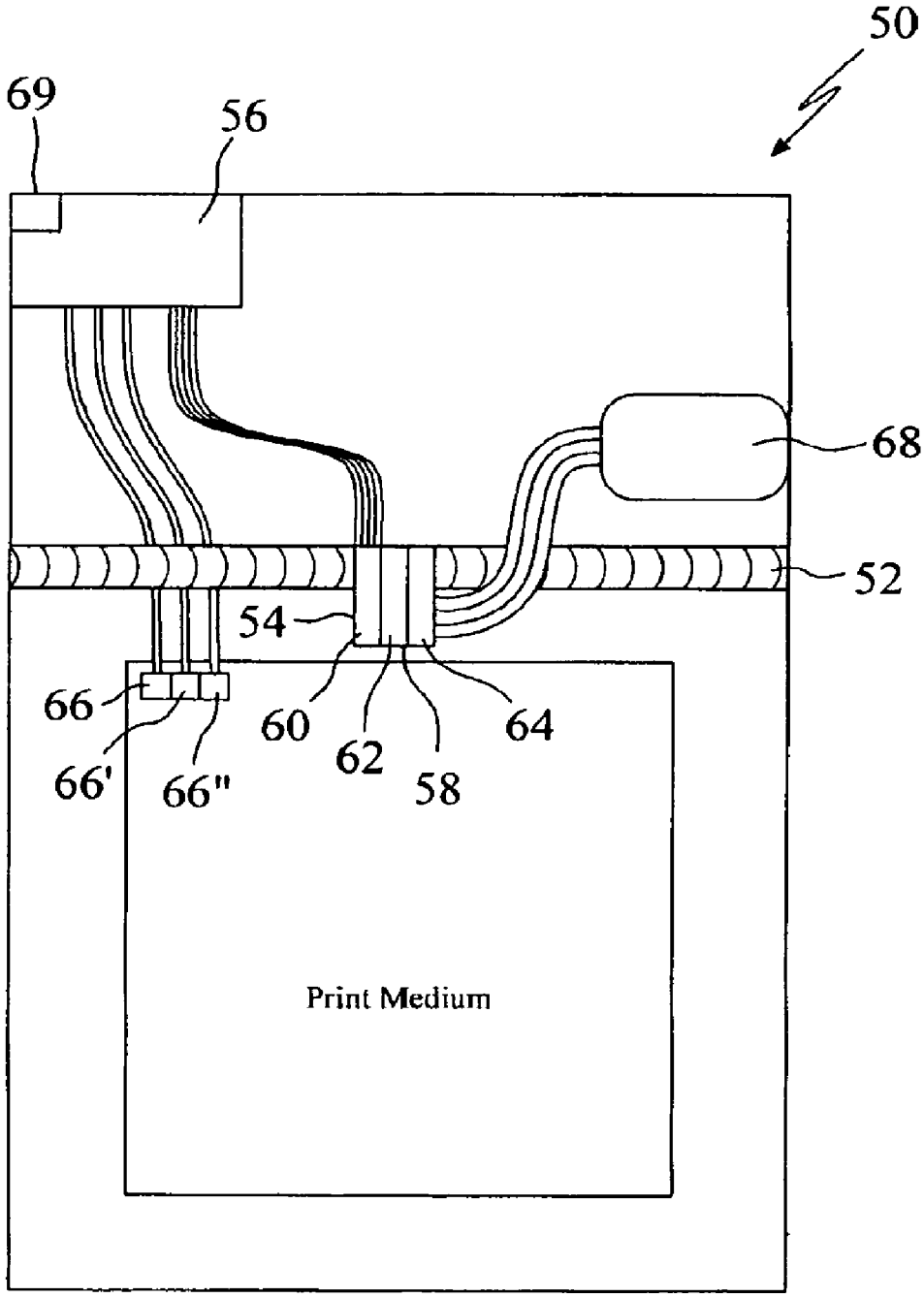
FIG. 7 is an overhead view of a second exemplary printer incorporating sensors in a fixed position and separate from an on-carrier printhead, where the sensors are operative to detect vapor accumulation below an ink filter in fluid communication with nozzles of a printhead.

Referring to FIG. 7, a second exemplary embodiment includes a printer 50 having a reel 52 along which a printhead 54 traverses. A drive mechanism (not shown), controlled by a printer controller 56, is operative to reposition the printhead 54 along the reel 52. The printhead 54 may include one or more banks of nozzles 58 adapted to provide orifices through which ink in fluid communication therewith is selectively deposited onto a print medium per the instructions received from the printer controller 56. To provide on-demand ink in fluid communication with the nozzles 58, the printhead 54 may be integrated with one or more ink reservoirs (printhead cartridges), may be fluidly coupled to one or more on-carrier ink cartridges, or may be in fluid communication with one or more off-carrier ink supplies. In this exemplary embodiment, the printhead 54 includes three bays 60, 62, 64 each in fluid communication with an ink supply.

The printer 50 also includes a stationary bank of sensors 66, 66', 66" (i.e., one sensor for each bay 60, 62, 64). Each sensor is communicatively connected to the printer controller 56 and operative to generate signals representative of the degree of vapor accumulation downstream from an ink filter (not shown) within a bay 60, 62, 64. In this manner, the printer controller 56 may provide an exemplary response, as discussed in the first exemplary embodiment, when one or more of the bays 60, 62, 64 includes an accumulation of vapor that might be problematic to printhead 54 longevity. It is to be further understood that by using a separate sensor 66, 66', 66" for each bay 60, 62, 64, the response may be bay-specific.

Figure 8:
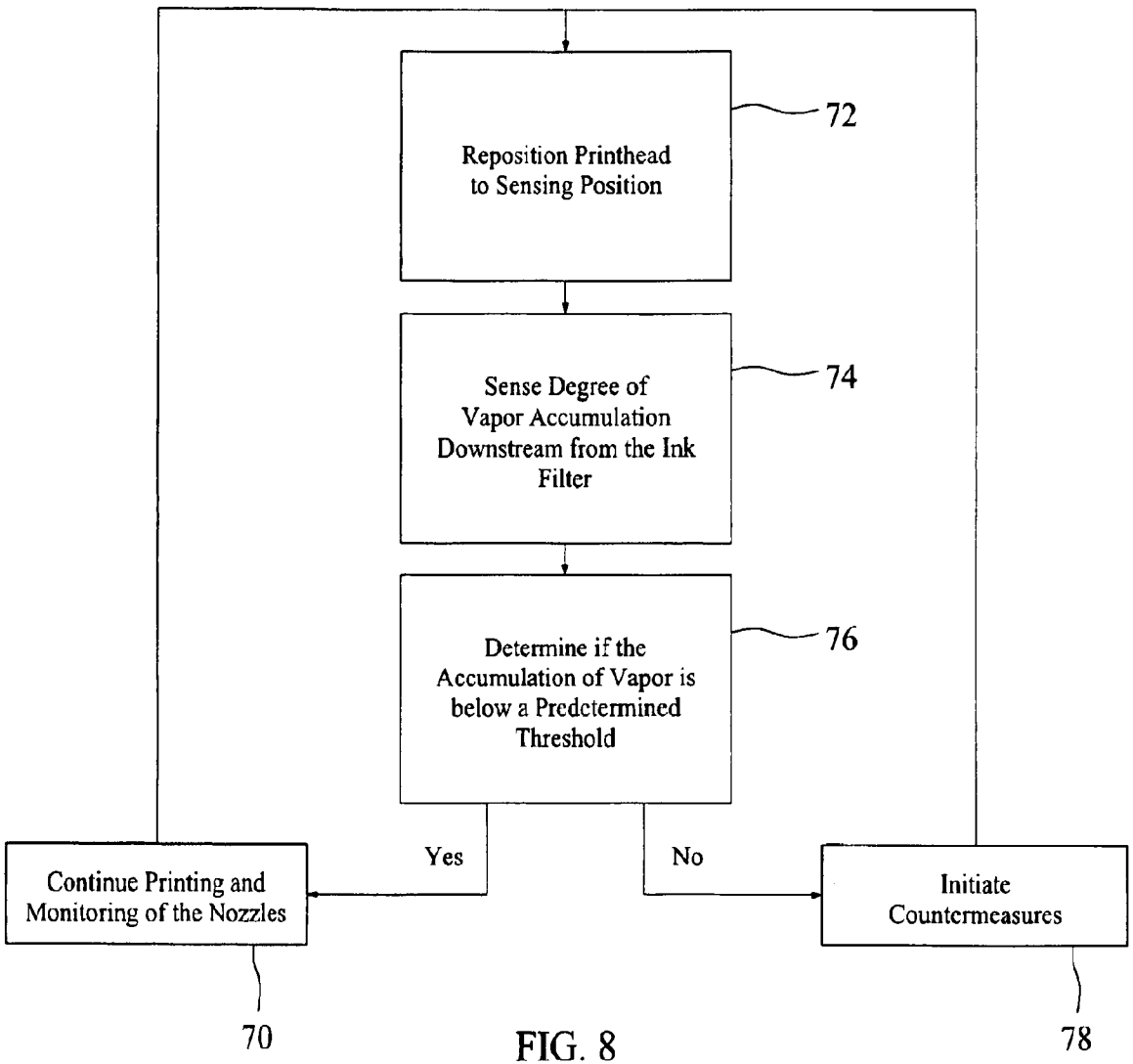
FIG. 8 is an flow diagram showing an exemplary process control sequence in accordance with the present invention.

Referencing FIG. 8, an exemplary flow diagram for use with the second exemplary embodiment may arbitrarily start at step 70 with the continued printing of the printer 50. The printer controller 56 is concurrently operative at step 70 to control the printing functions of the printhead 54 and to monitor the number and/or frequency of nozzle firings. At step 72, the printer controller 56 is operative to reposition the printhead 54 to a sensing position where each sensor 66, 66', 66" is positioned to detect the degree of vapor accumulation downstream from an ink filter (not shown) within each bay 60, 62, 64. The instruction to reposition the printhead 54 to the sensing position may be carried out as a standby protocol, as a start-up protocol, as a continued printing protocol, or other protocol. At step 74, each sensor 66, 66', 66" detects the degree of vapor accumulation downstream from the ink filter within a corresponding bay 60, 62, 64. The printer controller 56 at step 76 determines whether the sensor signals are indicative of vapor accumulation levels below a predetermined threshold. The predetermined threshold may take into account may factors within the purview of one of ordinary skill. If the printer controller 56 determines that the vapor downstream from the ink filter is not at or above the threshold value, the printing operations of the printer 50 are resumed or declared ready for service pending receipt of one or more print jobs. If the printer controller 56 determines that the vapor downstream from the ink filter is at or above the threshold value, one or more countermeasures may be initiated and carried out in step 78.

Exemplary countermeasures include notifying a user of the printer 50 that one or more ink cartridges need to be replaced. Further exemplary countermeasures include automatically initiating a purging or priming sequence using a pump, whether the pump creates a high pressure source upstream from the vapor accumulation area or a low pressure source downstream from the vapor accumulation area. It is to be understood that the countermeasures of the present invention encompass any response that provides at least one of vapor depletion/displacement or inhibits printing until such depletion/displacement occurs.

Subsequent to one or more of the countermeasures being carried out in step 78, the printer controller 56 is operative initiate step 72 and reposition the printhead 54 to the sensing position so that the degree of vapor accumulation downstream from each ink filter may be determined. It is to be understood that one or more of the countermeasures may take place while the printhead is already positioned at a sensing position and, thus, step 72 would be skipped and the printer controller would simply poll the sensors 66, 66', 66" at step 74 to determine whether additional countermeasures are necessary. It is also to be understood that after the countermeasures are carried out, printing may be continued without requiring the execution of steps 72-76.

Referencing FIG. 7, it is also within the scope of the invention to provide a single stationary sensor 66 that detects the degree of vapor accumulation downstream from the ink filter within each bay 60, 62, 64. In such an exemplary embodiment, a timer 69 may be associated with the printer controller 56 to incrementally reposition the printhead 54 along the reel 52 such that the sensor 66 would be aligned with a detection point associated with one of the bays 60, 62, 64 and operative to detect the vapor accumulation within one bay in sequence. An exemplary detection point includes a translucent window (not shown) associated with each bay 60, 62, 64 enabling detection of the vapor accumulation downstream from the ink filter within each bay 60, 62, 64.

Figure 9:
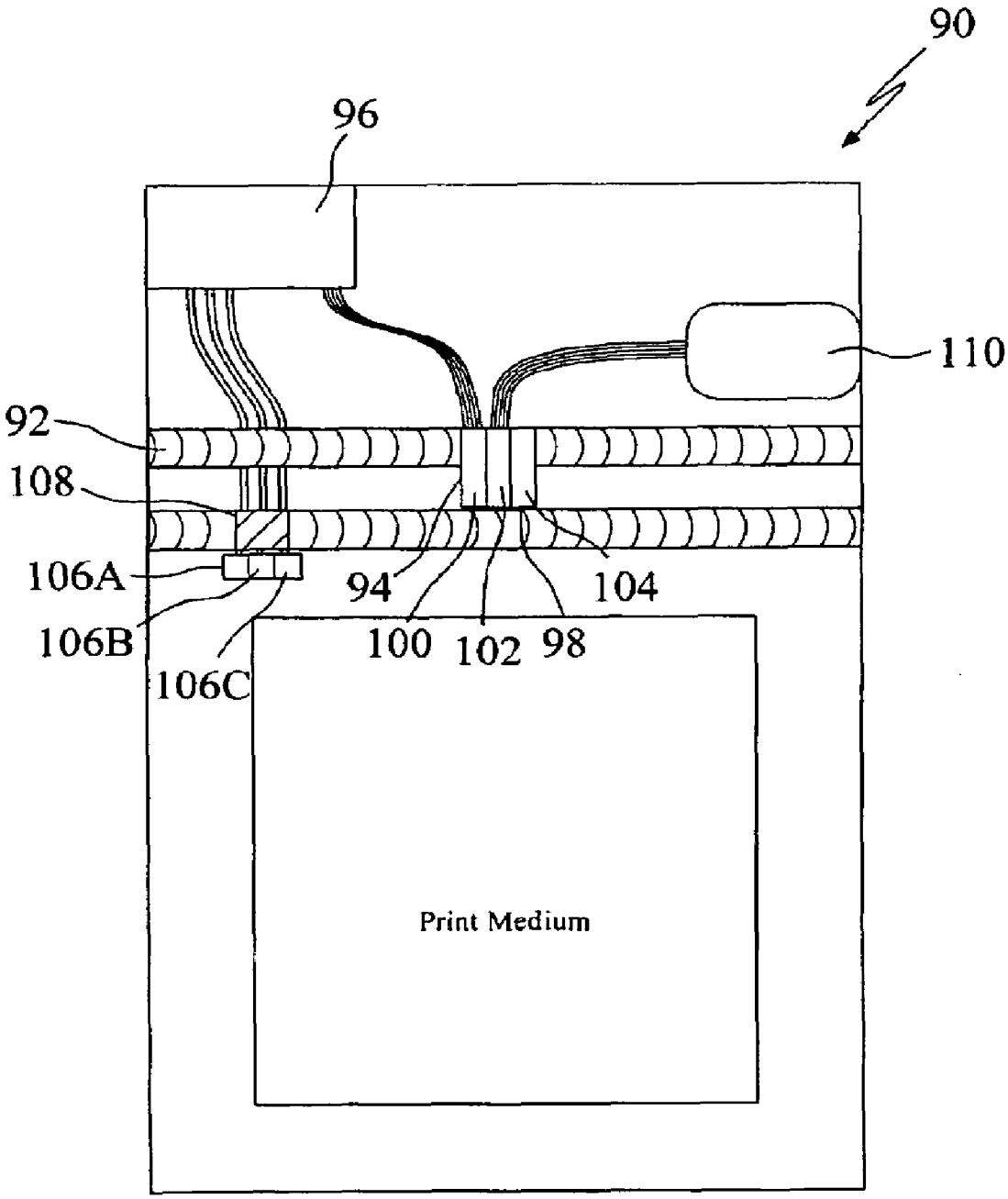
FIG. 9 is an overhead view of a third exemplary printer incorporating sensors that are repositionable and separate from an on-carrier printhead, where the sensors are operative to detect vapor accumulation below an ink filter in fluid communication with nozzles of a printhead.

Referencing FIG. 9, a third exemplary embodiment includes a printer 90 having a reel 92 along which a printhead 94 traverses. A drive mechanism (not shown), controlled by a printer controller 96, is operative to reposition the printhead 94 along the reel 92. The printhead 94 may include one or more banks of nozzles 98 adapted to provide orifices through which ink in fluid communication therewith is selectively deposited onto a print medium per the instructions received from the printer controller 96. To provide on-demand ink in fluid communication with the nozzles 98, the printhead 94 may be integrated with one or more ink reservoirs (printhead cartridges), may be fluidly coupled to one or more on-carrier ink cartridges, or may be in fluid communication with one or more off-carrier ink supplies. Those of ordinary skill are familiar with such alternatives. In this exemplary embodiment, the printhead 94 includes three bays each in fluid communication with a separate on-carrier cartridge 100, 102, 104.

The printer 90 also includes a bank of sensors 106A, 106B, 106C that are remotely mounted from the printhead 74. In this exemplary embodiment, the sensors 106A, 106B, 106C are mounted to a platform 108 of the printer 90 that is repositionable with respect to the printer and with respect to the printhead 94. Each sensor 106A, 106B, 106C is communicatively connected to the printer controller 96 and is operative to relay signals to the printer controller 96 that are representative of the amount of accumulated vapor below the filter in fluid communication with each cartridge 100, 102, 104.

In practice, the repositionable platform 108 receives instructions from the printer controller 96 that correspond to and approximately match the side-to-side movement of the printhead 94 so that the sensors 106A, 106B, 106C can monitor the accumulation of vapor downstream from the ink filter as the printhead 94 traverses across the printable medium. Using the signals generated by the sensors 106A, 106B, 106C, the printer controller 96 determines whether the accumulation of vapor downstream from the ink filter may be problematic to printhead 94 longevity. If the level of vapor downstream from the ink filter is beyond a predetermined threshold value, the printer controller 96 may activate countermeasures adapted to reduce the level of vapor and/or inhibit further printing until the level of vapor drops or is eliminated. These countermeasures may include notifying a user of the printer that a cartridge 100, 102, 104 needs to be replaced, or automatically initiating a purging sequence using a purge pump 110 to decrease the degree of vapor accumulation. It is to be understood that the countermeasures include any response that provides at least one of vapor depletion/displacement, inhibits printing until such depletion/displacement occurs, or provides instructions or notification to alleviate the current problem.

It is to be further understood that by using a separate sensor 106A, 106B, 106C corresponding to the flow of ink attributable to a cartridge 100, 102, 104, the countermeasures may be specific to conditions of a particular cartridge. In an exemplary instance, the printer controller 96 may initiate an automated purging sequence using the purge pump 110 to purge ink from only one of the cartridges. Alternatively, or in addition, the controller 96 may alert a user that printing operations should be suspended and prompting for a manual purge or other remedy that may be cartridge specific.

Exemplary sensors for use with the present invention include, without limitation, light emitting sources such as light emitting diodes (LEDs), infrared emitting diodes (IRDs), and photodiodes, coupled with a light receiver/detector such as a phototransistor. It is to be understood that while the exemplary sensors discussed above have been optical in nature, those of ordinary skill will understand that other sensors, such as pressure sensors, may be used in lieu of optical sensors or in addition to optical sensors to detect the accumulation of vapor downstream from an ink filter.

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A method of monitoring gaseous accumulation within an ink flow path in fluid communication with a printhead comprising:

supplying a first printhead with ink using a first ink flow path;

mounting a first ink filter in fluid communication with the first printhead;

sensing downstream from the first ink filter for gaseous components within the first ink flow path;

generating a signal in response to sensing gaseous components downstream from the first ink filter; and signaling a user of a printer that gaseous components have been detected downstream from the first ink filter and providing instructions for redirecting at least some of the gaseous components.

2. The method of claim 1, wherein the downstream sensing within the first ink flow path includes utilizing an optical sensor.

3. The method of claim 2 wherein the optical sensor is a component of at least one of a removable ink tank and the first printhead.

4. The method of claim 2, wherein: the first printhead traverses across a reel of a printer; and the optical sensor is stationary with respect to the first printhead.

5. The method of claim 2, wherein: the first printhead traverses across a reel of a printer; and the optical sensor is stationary with respect to the printer.

6. A method of monitoring gaseous accumulation within an ink flow path in fluid communication with a printhead comprising:

supplying a first printhead with ink using a first ink flow path;

mounting a first filter in fluid communication with the first printhead;

sensing downstream from the first ink filter for gaseous components within the first ink flow path;

supplying a second printhead with ink using a second ink flow path;

mounting a second ink filter in fluid communication with the second printhead;

sensing downstream from the second ink filter for gaseous components within the second ink flow path;

supplying a third printhead with ink using a third ink flow path;

mounting a third ink filter in fluid communication with the third printhead; and sensing downstream from the third ink filter for gaseous components within the third ink flow path.

7. The method of claim 6, wherein:

the first printhead, the second printhead, and the third printhead traverses across a reel of a printer; and supplying the first printhead, the second printhead, and the third printhead with ink includes providing at least one removable reservoir in fluid communication therewith.

8. The method of claim 7, wherein:

the downstream sensing within the first ink flow path the second ink flow path and the third ink flow path includes utilizing an optical sensor; and the optical sensor is stationary with respect to the printer.

9. The method of claim 7, wherein:

the downstream sensing within the first ink flow path, the second ink flow path, and the third ink flow path includes utilizing a plurality of optical sensors; and at least one of the plurality of optical sensors is stationary with respect to the printer.

10. The method of claim 7, further comprising:

generating a signal in response to sensing gaseous components downstream from at least one of the first ink filter, the second ink filter, or the third ink filter; and signaling a user of the printer that gaseous components have been detected downstream from at least one of the first ink filter, the second ink filter, or the third ink filter and providing instructions for redirecting at least some of the gaseous components.

11. The method of claim 7, further comprising:

generating a signal in response to sensing gaseous components downstream from at least one of the first ink filter, the second ink filter, or the third ink filter; and automatically redirecting a least some of the gaseous components in response to the signal generation.

12. A method of monitoring gaseous accumulation within an ink flow path in fluid communication with a printhead comprising:

supplying first printhead with ink using a first ink flow path;

mounting a first ink filter in fluid communication with the first printhead;

sensing downstream from the first ink filter for gaseous components within the first ink flow path;

generating a signal in response to sensing gaseous components downstream from the first ink filter; and automatically redirecting at least some of the gaseous components in response to the signal generation.

* * * * *